US007117560B2

(12) United States Patent
Yu Chen

(10) Patent No.: US 7,117,560 B2
(45) Date of Patent: Oct. 10, 2006

(54) HANDLE OF AN ADHESIVE-TAPE CUTTER ABLE TO ACCOMMODATE ARTICLES

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 35 days.

(21) Appl. No.: 10/900,294

(22) Filed: Jul. 28, 2004

(65) Prior Publication Data

US 2006/0021193 A1 Feb. 2, 2006

(51) Int. Cl.
*B25G 1/04* (2006.01)

(52) U.S. Cl. ..... 16/111.1; 16/436

(58) Field of Classification Search ..... 16/111.1, 16/110.1, 430, 431, DIG. 12, DIG. 19, 436; 81/117.1, 427.5, 489; 30/340; 156/579; 173/169, 162.1; 451/357–359, 344; 408/241 R
See application file for complete search history.

(56) References Cited

U.S. PATENT DOCUMENTS 4,393,539 A * 7/1983 Weissman ..... 16/426
5,640,741 A * 6/1997 Yano ..... 16/421
5,782,150 A * 7/1998 Huang ..... 81/177.4
5,813,805 A * 9/1998 Kopras ..... 408/241 R
5,918,513 A * 7/1999 Ho ..... 81/490
6,070,301 A * 6/2000 Fallandy ..... 16/431
6,138,734 A * 10/2000 Hamisch, Jr. ..... 156/384
6,152,639 A * 11/2000 Hsu ..... 403/116
6,581,247 B1 * 6/2003 Yu Chen ..... 16/430

FOREIGN PATENT DOCUMENTS

CH 675388 A5 * 9/1990
EP 1236545 A2 * 9/2002
EP 1479486 A2 * 11/2004
JP 2004174672 A * 6/2004

* cited by examiner

*Primary Examiner*—Chuck Y. Mah
(74) *Attorney, Agent, or Firm*—Troxell Law Office, PLLC

(57) ABSTRACT

The handle of an adhesive-tape cutter able to accommodate articles includes a lower rear shell, an upper fixing base and a lower front cover. The lower shell has a holding portion at its topside formed integral with a fixing base combined with the upper fixing base. The holding portion and the lower front cover are respectively formed with an accommodating groove matching with each other and having plural positioning ribs provided inside for placing articles needed for packing work of adhesive tape. The lower front cover has its upper and lower end respectively provided with an insert block and an elastic engage block respectively engaged with the insert groove of the upper fixing base and the engage groove of the lower rear shell to let the lower front cover assembled with or disassembled from the lower rear shell conveniently.

6 Claims, 6 Drawing Sheets

HANDLE OF AN ADHESIVE-TAPE CUTTER ABLE TO ACCOMMODATE ARTICLES

BACKGROUND OF THE INVENTION

1. Field of the Invention

This invention relates to a handle of an adhesive-tape cutter able to accommodate articles, particularly to one composed of a lower front cover and a lower rear shell which can be disassembled from each other or assembled together to form an accommodating space for placing articles therein.

2. Description of the Prior Art

A conventional adhesive-tape cutter 10, as shown in FIG. 1, includes a handle frame 11, a blade base 12, a roller 13, an adhesive-tape roll holder 14 and a blade 15. The handle frame 11 has a handle 111 fixed under and a fixing base 112 fixed on the upper side. The fixing base 112 has its front side provided with an elastic press plate 113 and one lateral side provided with a side plate 114 extending upward for the blade base 12, the roller 13 and the adhesive-tape roll holder 14 to be positioned thereon, with the blade 15 assembled on the blade base 12. Thus, after an adhesive-tape roll (not shown) is assembled on the adhesive-tape roll holder 14 of an adhesive-tape cutter 10, the adhesive tape on the adhesive-tape roll can be drawn outward and inserted through the gap between the roller 13 and the blade base 14 to be used in packing.

However, the handle 111 of the conventional adhesive-tape cutter 10 is formed integral with the handle frame 11; therefore, it has no other functions except being held by a user during carrying out packing work. It is indeed a pity not to make use of the interior space of the handle 111 of the conventional adhesive-tape cutter 10, which after properly designed, some necessary articles, such as an art knife, a marker and the like, can be placed therein.

SUMMARY OF THE INVENTION

The objective of the invention is to offer a handle of an adhesive-tape cutter able to accommodate articles. The handle is composed of a lower rear shell, an upper-fixing base and a lower front cover. The lower rear shell is formed with a holding portion having its topside formed integral with a fixing base to be combined with the upper fixing base. The holding portion of the lower rear shell and the lower front cover are combined together to form an accommodating space having plural positioning ribs provided therein for placing articles needed for packing work of adhesive tape. The lower front cover has its upper and lower end respectively provided with an insert block and an elastic engage block to be respectively engaged with the insert groove at the lower side of the upper fixing base and the engage groove at the lower end of the lower rear shell. Thus, the lower front cover can be assembled with or disassembled from the lower rear shell, convenient in handling and having excellent industrial practicability.

BRIEF DESCRIPTION OF DRAWINGS

This invention will better understood by referring to the accompanying drawings, wherein.

DETAILED OF THE PREFERRED EMBODIMENT

Figure 1:
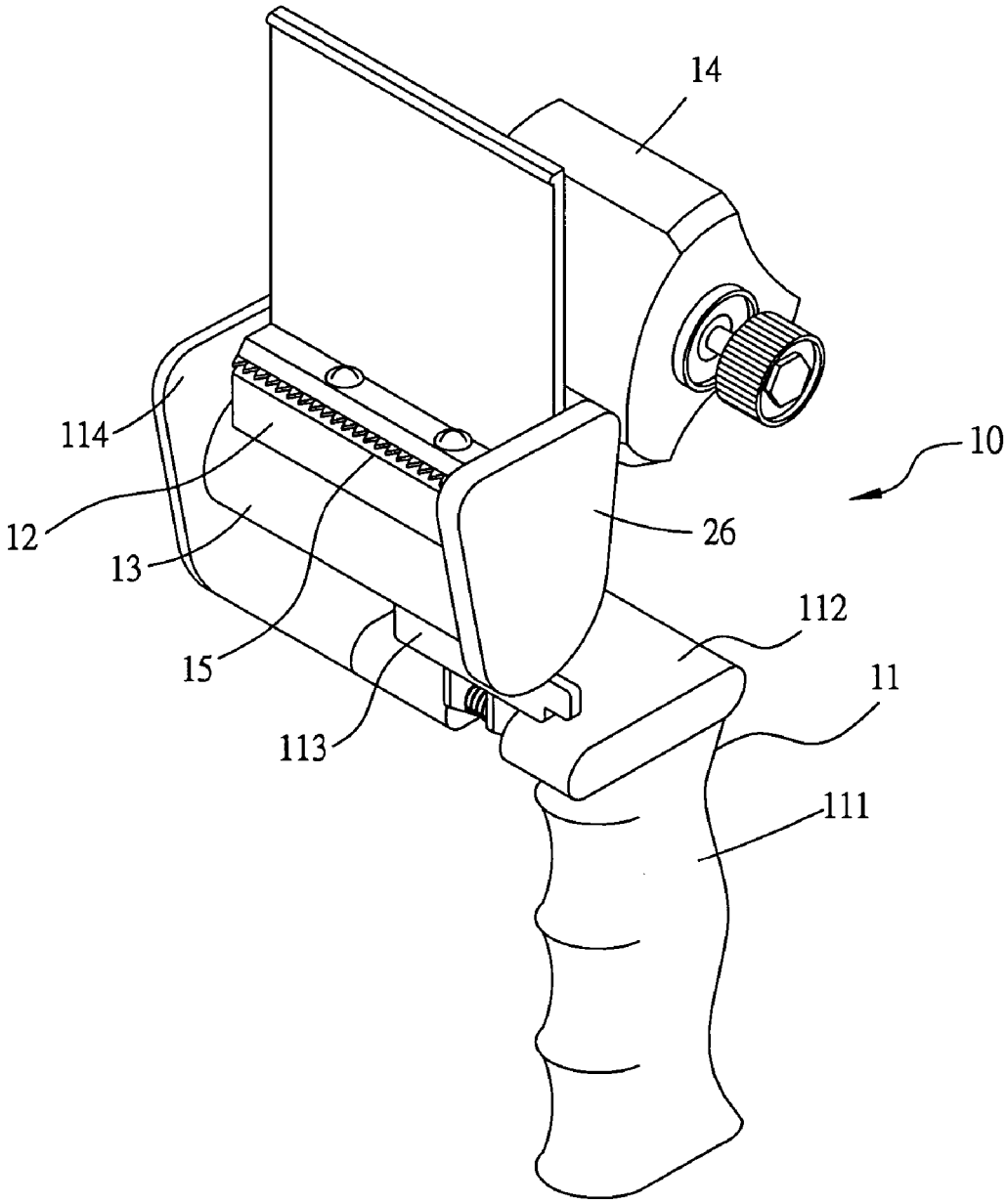
FIG. 1 PRIOR ART
FIG. 1 is a perspective view of a conventional adhesive-tape cutter.
Figure 2:
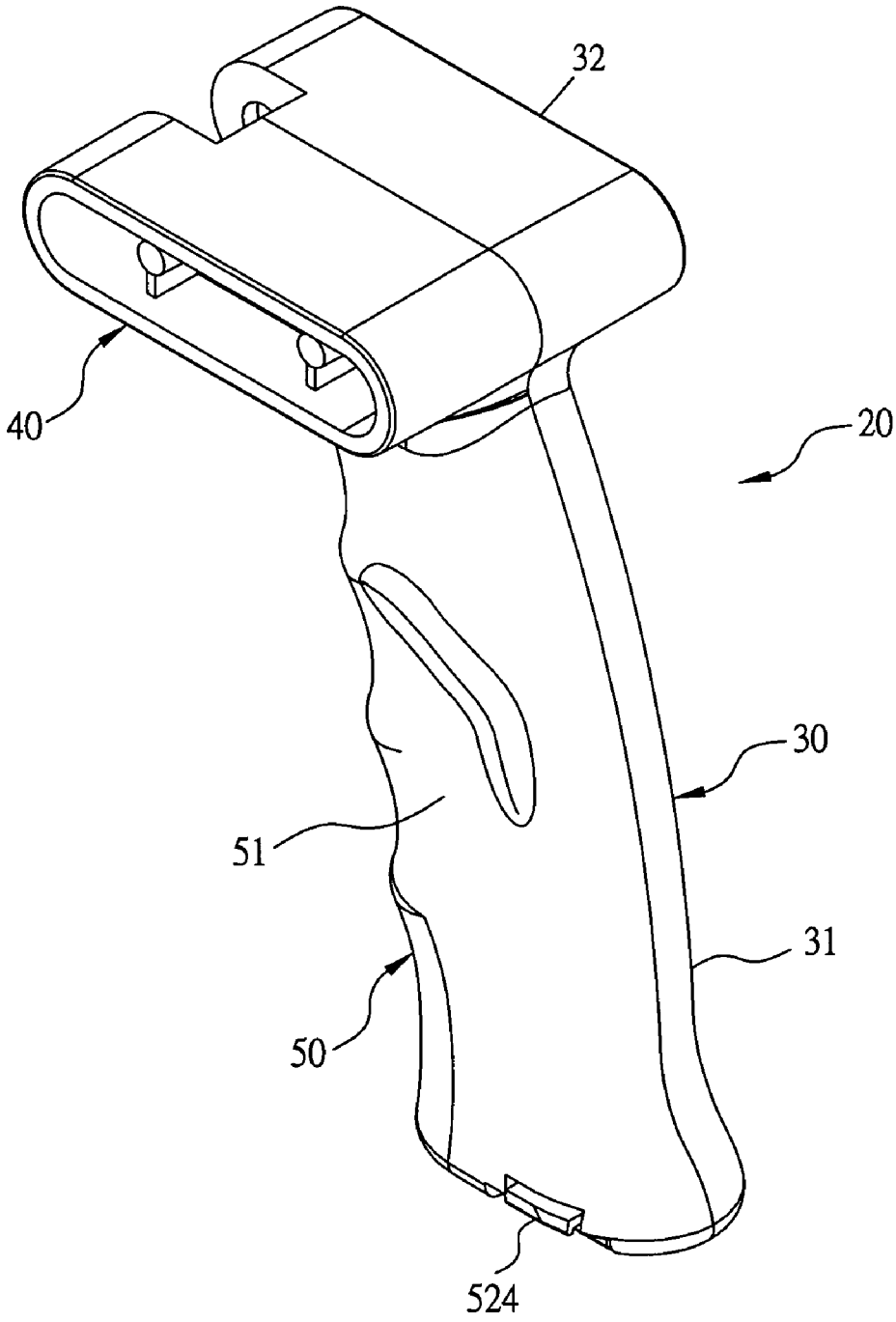
FIG. 2 is a perspective view of a first preferred embodiment of the handle of an adhesive-tape cutter in the present invention.
Figure 3:
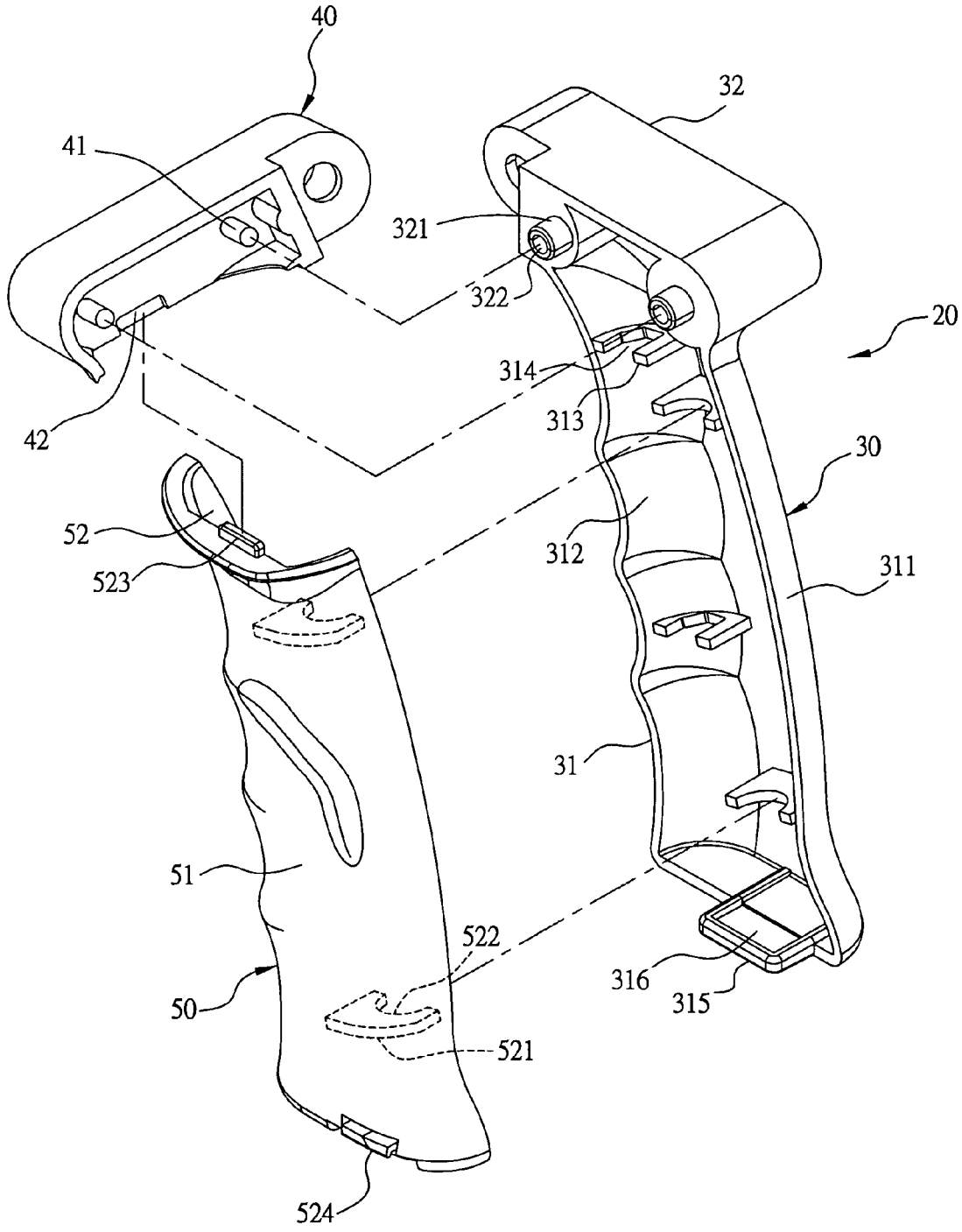
FIG. 3 is an exploded perspective view of the first preferred embodiment of the handle of the adhesive-tape cutter in the present invention.

A first preferred embodiment of a handle 10 of an adhesive-tape cutter able to accommodate articles in the present invention, as shown in FIGS. 2 and 3, includes a lower rear shell 30, an upper fixing base 40 and a lower front cover 50 combined together.

The lower rear shell 30 has one side formed with a semi-shell shaped holding portion 31 with a holding surface 311 and the other side formed with an accommodating groove 312 having the opposite inner walls respectively provided at preset portions with positioning ribs 313 respectively having its front portion cut with a positioning groove 314 of a preset shape. Further, the accommodating groove 312 has its lower wall provided with an engage member 315 vertically extending out of the groove 312 and having its inner side bored with an engage groove 316 at a preset location. The holding portion 31 of the lower shell 30 has its topside formed integral with a preset-shaped fixing base 32 extending horizontally. The fixing base 32 has two sidewise studs 321 respectively provided at preset locations aligned to the groove edge of the holding portion 31, with each stud 321 having a central insert hole 322.

The upper fixing base 40 has its inner side provided with two insert rods 41 protruding horizontally to be inserted and positioned in the two insert holes 322 of the two studs 321 of the fixing base 32 of the lower rear shell 30 and then glued together to firmly assemble the upper fixing base 40 with the fixing base 32 of the lower rear shell 30. The upper fixing base 40 is further bored with an insert groove 42 in the lower side near the central portion.

Figure 4:
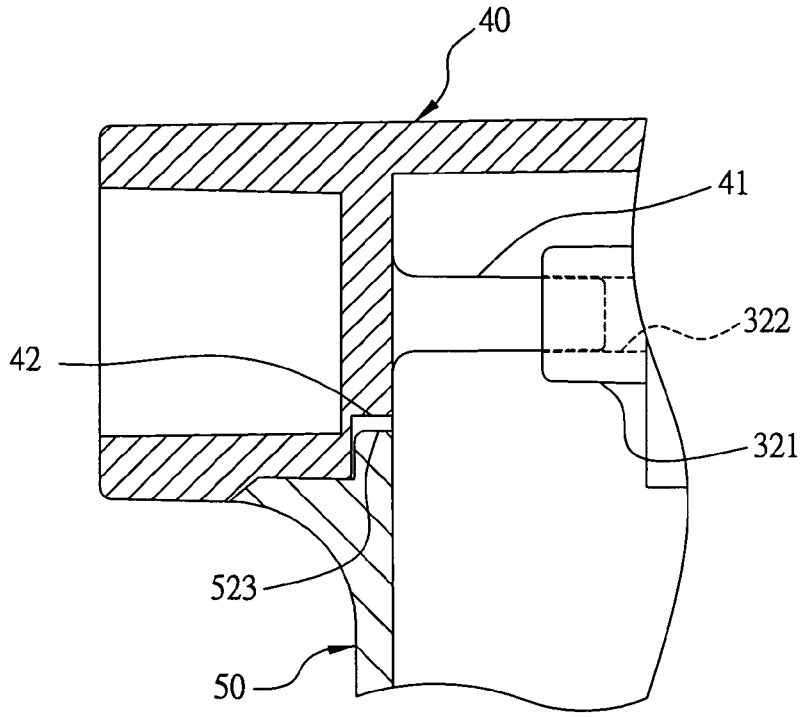
FIG. 4 is a side cross-sectional view of the lower front cover and the fixing base of the handle in the first preferred embodiment in a mutual inserted condition in the present invention.
Figure 5:
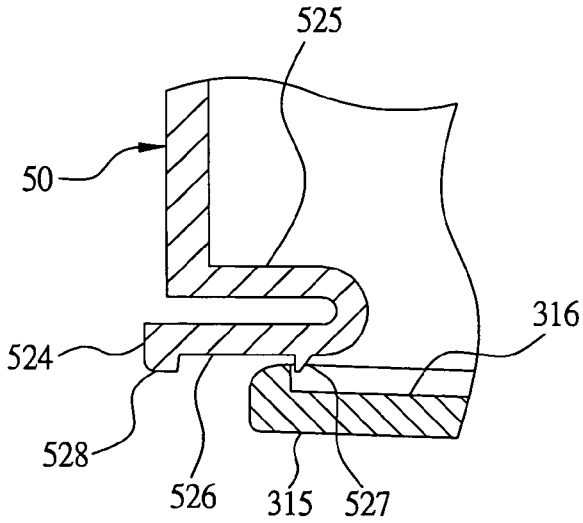
FIG. 5 is a side cross-sectional view of the flower front cover and the lower rear shell of the handle in the first preferred embodiment in the present invention.

The lower front cover 50 is a semi-shell shaped holding body having one side formed with a holding surface 51 and the other side formed with an accommodating groove 52 having the upper and the lower portion of its bottom wall respectively fixed with a preset-located positioning rib 521 having a preset-shaped positioning groove 222 bored at the topside. In addition, the accommodating groove 52 is defined by a vertical wall having its upper end provided with an insert block 523 to be inserted and positioned in the insert groove 42 at the lower side of the upper fixing base 40, as shown in FIG. 4, and its lower end provided with an elastic engage block 524 bent to form an inner plate 525 and an outer plate 526 parallel to each other, as shown in FIG. 5. The outer elastic plate 526 is provided with an engage projection 527 protruding downward near its bent portion to engage with the engage groove 316 of the lower shell 30. Further, the outer plate 526 has a pull projection 528 provided at its outer end to be pulled to disengage the engage projection 527 of the outer plate 526 from the engage groove 316 of the lower shell 30 so as to separate the upper cover 50 from the lower shell 30.

Figure 6:
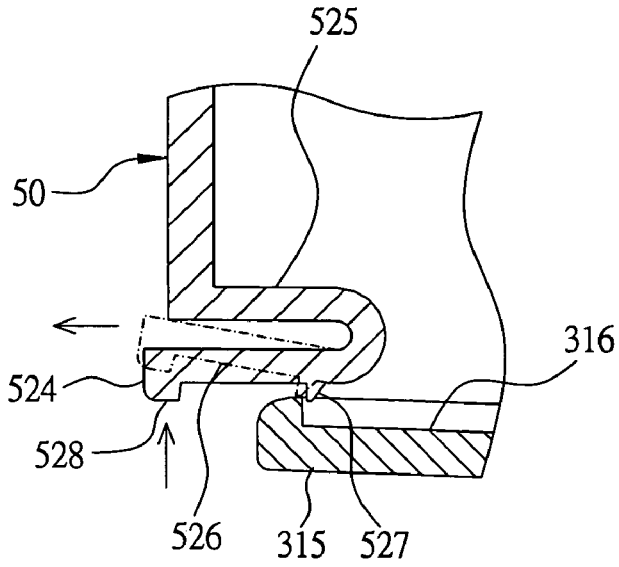
FIG. 6 is a side cross-sectional view of the elastic engage block of the lower front cover of the handle in the first preferred embodiment in an engaging condition in the present invention.

To place articles in the accommodating groove 52 of the handle 20, as shown in FIGS. 5 and 6, firstly, pull the pull projection 528 at the outer end of the elastic engage block 524 of the lower front cover 50 to let the elastic bent outer plate 526 actuate the engage projection 527 to move away from the engage member 315 of the lower rear shell 30 and then disengaged from the engage groove 316 of the engage member 315, thus separating the lower end of the lower front cover 50 from the lower rear shell 30. Then, the lower front cover 50 is moved downward obliquely to separate the insert block 523 at its upper end from the insert groove 42 at the lower side of the upper fixing base 40. Next, articles, such as an art knife (a) and a marker (b) in this preferred embodiment, are placed in the accommodating groove 312 and held in position in the positioning grooves 314 of the positioning ribs 313.

Lastly, the insert block 523 at the upper end of the lower front cover 50 is inserted in the insert groove 42 at the lower side of the upper fixing base 40, and then the lower front cover 50 is pressed downward to let the engage projection 527 of the outer plate 526 of the elastic engage block 524 engaged with the engage groove 316 of the engage member 315 of the lower rear shell 30 to finish the combination of the lower front cover 50 with the lower shell 30. The articles positioned in advance in the accommodating groove 312 of the lower rear shell 30 will also be held by the positioning grooves 522 of the positioning ribs 521 of the lower front cover 50 and stably positioned in the handle 20 after the lower front cover 50 and the lower rear shell 30 are combined together.

Figure 8:
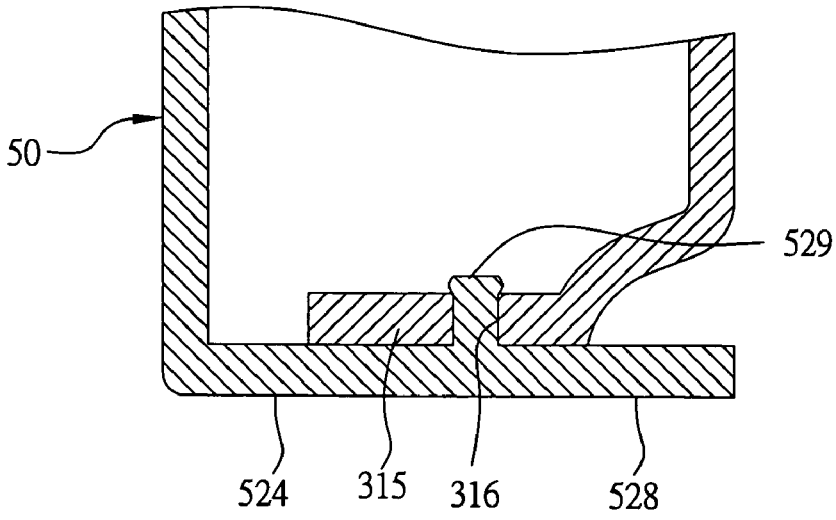
FIG. 8 is a side cross-sectional view of a second preferred embodiment a handle having the lower front cover and the elastic engage block of the lower rear shell engaged with each other in the present invention.
Figure 7:
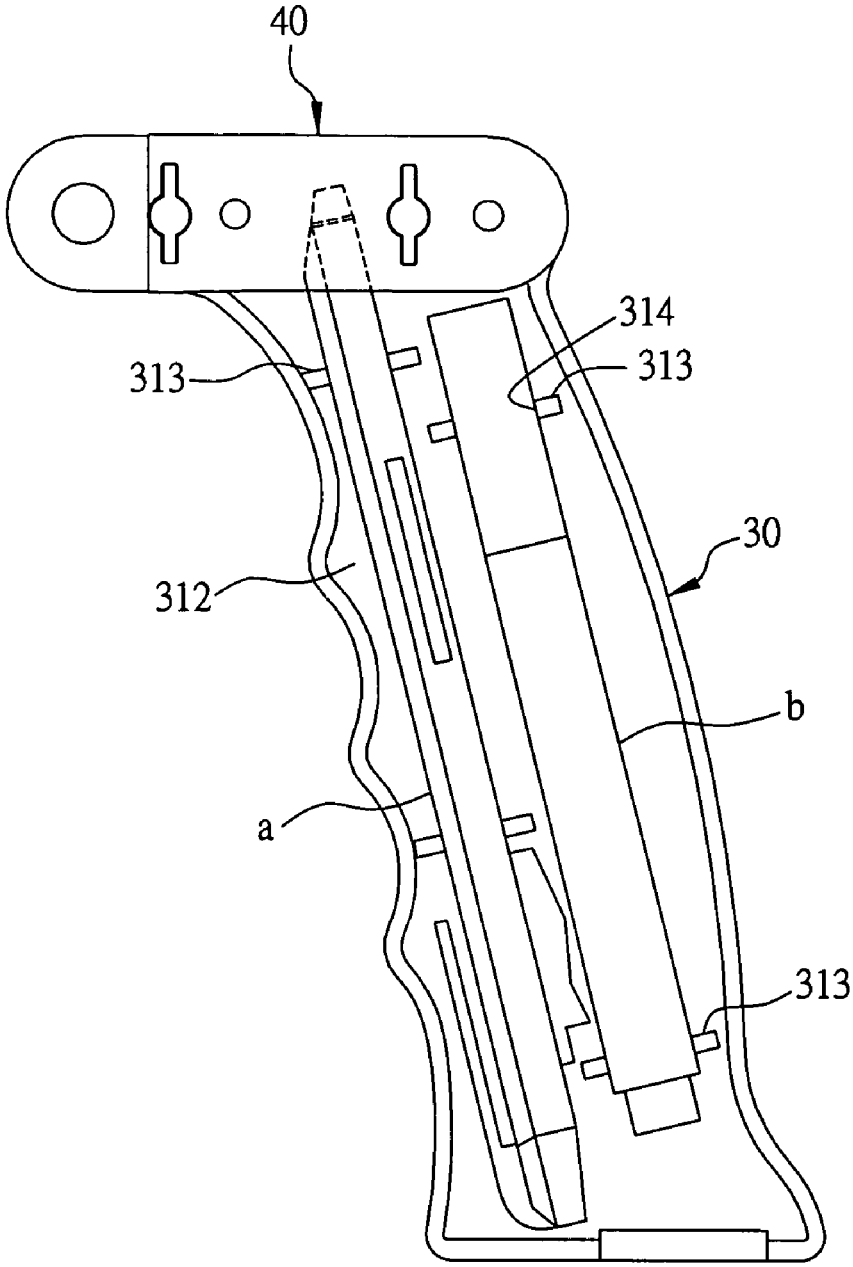
FIG. 7 is a cross-sectional view of the lower rear shell of the handle in the first preferred embodiment of the lower shell of the handle, having articles placed therein in the present invention.

A second preferred embodiment of the handle of an adhesive-tape cutter able to accommodate articles in the present invention, as shown in FIG. 8, has the same lower rear shell 30 and the lower front cover 50 as those described in the first preferred embodiment, except that the engage member 315 of the lower rear shell 30 has its outer edge cut with a vertical engage slot 316 at a preset location and the lower front cover 50 has its lower end bent inward for 90 degrees and formed with an elastic plate 524 having a vertical engage stud 529 provided at a preset location of the inner side. Thus, the lower front cover 50 and the lower rear shell 30 can be quickly combined together by mutual engagement of the engage stud 529 of the elastic plate 524 of the lower front cover 50 and the engage slot 316 of the engage member 315 of the lower rear shell 30. Further, the elastic plate 524 of the lower front cover 50 has its outer end extending forward and formed with a pull edge 528, which can be pulled outward to disengage the engage stud 529 of the elastic plate 524 from the engage slot 316 of the engage member 315 to separate the lower front cover 50 from the lower rear shell 30.

As can be understood from the above description, this invention has the following advantages.

1. The handle 20 is formed inside with an accommodating groove 312 for receiving articles employed in a packing process of adhesive tape, elevating convenience and work efficiency in packing work of adhesive tape.

2. The upper cover 50 and the lower shell 30 of the handle 20 are combined by insertion and elastic engagement so they can be assembled or disassembled quickly and conveniently.

3. The upper cover 50 and the lower shell 30 of the handle 20 are simple in structure, lowering producing cost and conforming to producing benefit.

While the preferred embodiment of the invention have been described above, it will be recognized and understood that various modifications may be made therein and the appended claims are intended to cover all such modifications that may fall within the spirit and scope of the invention.

I claim:

1. A handle of an adhesive tape cutter for accommodating articles comprising:

a) a rear shell having:

I) a semi-shell shaped holding body having a rear holding surface defining a rear accommodating groove; and ii) an engage groove located on an bottom of the rear accommodating groove;

b) an upper fixing base located on an upper portion of a front the rear shell and having an insert groove; and c) a lower front cover located on a lower portion of the front of the rear shell; and having:

I) a semi-shell shaped holding body having a front holding surface defining a front accommodating groove;

ii) an insert block located on a top of the holding surface and inserted into the insert groove of the upper fixing base; and iii) an elastic engage block located on a bottom of the holding surface and elastically engaging the engage groove of the rear shell, wherein the lower front cover selectively connected to and separated from the rear shell allowing the articles to be placed in a combined accommodating space defined by the rear accommodating groove and the front accommodating groove.

2. The handle according to claim 1, wherein the rear shell has a fixing base located on the upper portion thereof, the upper fixing base is connected to the fixing base of the rear shell.

3. The handle according to claim 1, further comprising a plurality of positioning ribs located on the rear holding surface in the rear accommodating groove and front holding surface in the front accommodating groove, each of the plurality of positioning ribs has a positioning groove located on an inner most edge.

4. The handle according to claim 1, wherein the rear shell has an engage member located on an outer periphery of the engage groove, the elastic engage block of the lower front cover includes:

a) an inner plate; and b) an outer plate connected to the inner plate by an bent portion and positioned parallel to the inner plate in a normal position, the outer plate has an engage projection located adjacent to the bent portion and a pull projection located on an end opposite the bent portion, the engaging projection of the lower front cover selectively engaging the engage groove of the rear shell, the lower front cover is separated from the rear shell by pressing the pull projection and separating the engaging projection from the engage groove.

5. The handle according to claim 1, wherein the rear shell has an engage member located on an outer periphery of the engage groove, the elastic engage block of the lower front cover has an engage stud and a pull projection located on an end opposite the rear holding surface, the engage stud of the lower front cover selectively engaging the engage groove of the rear shell, the lower front cover is separated from the rear shell by pressing the pull projection and separating the engaging projection from the engage groove.

6. The handle according to claim 1, wherein the rear shell has a fixing base located on the upper portion thereof, the fixing base has two studs, each of the two studs has a an insert hole, the upper fixing base has two insert rods, one of the two insert rods is inserted into the insert hole of each of the two studs such that the upper fixing base is connected to the rear shell.

* * * * *